United States Patent [19]

Caravaty

[11] Patent Number: 4,998,730

[45] Date of Patent: Mar. 12, 1991

[54] CARD POCKET EQUIPPED CARD GAME PLAYING PANEL

[76] Inventor: Raymond D. Caravaty, 534 West St., Pittsfield, Mass. 01201

[21] Appl. No.: 486,388

[22] Filed: Feb. 28, 1990

[51] Int. Cl.[5] ..... A63F 1/10

[52] U.S. Cl. ..... 273/148 A

[58] Field of Search ..... 273/148 R, 148 A, 285, 273/294; 434/172, 430

[56] References Cited

U.S. PATENT DOCUMENTS

| | | | |
|---|---|---|---|
| 1,323,779 | 12/1919 | McDade | 434/172 |
| 1,880,175 | 9/1932 | Geibel | 273/148 A X |
| 2,115,276 | 4/1938 | Morse | 273/148 A |
| 2,150,850 | 3/1939 | Smith | 273/148 A |
| 2,450,325 | 9/1948 | Zirin . | |
| 3,667,757 | 6/1972 | Holmbery . | |
| 4,317,515 | 3/1982 | Feeley et al. | 273/294 X |
| 4,408,993 | 10/1983 | Osborne | 434/172 X |
| 4,436,324 | 3/1984 | Barton | 273/285 X |

*Primary Examiner*—William H. Grieb

*Attorney, Agent, or Firm*—Fleit, Jacobson, Cohn, Price, Holman & Stern

[57] ABSTRACT

A stiff card game playing panel is provided and a plurality of stiff members are wrapped with adhesive coated decorative sheets having free end portions adhesively secured to the panel in positions relative to each other and in conjunction with spacing strips in order to form a plurality of card receiving pockets on the card playing panel. Thus formed, each packet is completely seamless. This is important because even a butted joint interferes with the insertion of a playing card.

15 Claims, 2 Drawing Sheets

CARD POCKET EQUIPPED CARD GAME PLAYING PANEL

BACKGROUND OF THE INVENTION

1. Field of the Invention

This invention relates to a panel for supporting a plurality of cards in a predetermined, orderly manner and with the supported cards being anchored relative to the panel against shifting relative thereto due to wind, vibration or upset of the panel. The panel may be constructed to support only the cards being played by a single player or all of the played cards during a game by a plurality of game players.

2. Description of Related Art

Various different forms of card holding game panels, card game boards, game packages and card game playing aids heretofore have been provided including some of the general structural and operational features of the instant invention. Examples of these different devices are disclosed in U.S. Pat. Nos. 1,880,175, 2,115,276, 2,150,850, 2,450,325, 3,667,757, 4,317,515 and 4,436,324. However, these previously known devices do not include the overall combination of structural and operational features of the instant invention which coact to provide a simple, readily constructed, durable and easy to use playing card holder.

SUMMARY OF THE INVENTION

The card game playing panel of the instant invention is uniquely modified to incorporate at least one playing card receiving pocket thereon in which a plurality of playing cards may be received and frictionally retained against shifting relative to the panel due to wind, vibration or even upset of the panel.

The panel may be constructed to hold all of the "hand" cards of a person playing a card game, it may be constructed to hold all of the "played" cards during a card game, or it may include a plurality of playing card receiving pockets for receiving therein all "played" cards during a card game as well as the "unplayed" cards of at least one player of a card game.

The main object of this invention is to provide a game card holding panel which may be used to support one or more groups of a plurality of playing cards against shifting relative to the panel as a result of wind, vibration or upset of the panel.

Another object of this invention is to provide a basic playing card receiving pocket structure in conjunction with a support panel and wherein the pocket structure is operative to receive a plurality of playing cards therein in a manner frictionally resisting the dislodgement of the playing cards from the pocket.

Yet another object of this invention is to provide a card game panel with playing card pocket means operatively associated therewith constructed in a manner whereby the pocket may effectively frictionally retain as few as a single playing card therein or numerous playing cards therein against dislodgement therefrom.

Another important object of this invention is to provide a playing card receiving pocket on a card game playing panel with the pocket defining structure associated with the panel being readily formed by an adhered to the panel through the utilization of simple and inexpensive structural components.

Another object of this invention is to provide playing card receiving pocket structure for use in conjunction with a card game playing panel and wherein the playing card receiving pocket structure is constructed in a manner so as to be readily positionable in numerous selected positions upon the panel.

Still another object of this invention is to provide playing card receiving pocket defining structure in conjunction with a support panel therefore and wherein a pair of adjacent playing card receiving pocket defining structures coact with each to enable one or more playing cards received in one of the pocket defining structures to be frictionally retained therein.

A final object of this invention to be specifically enumerated herein is to provide a card pocket equipped card game playing panel in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
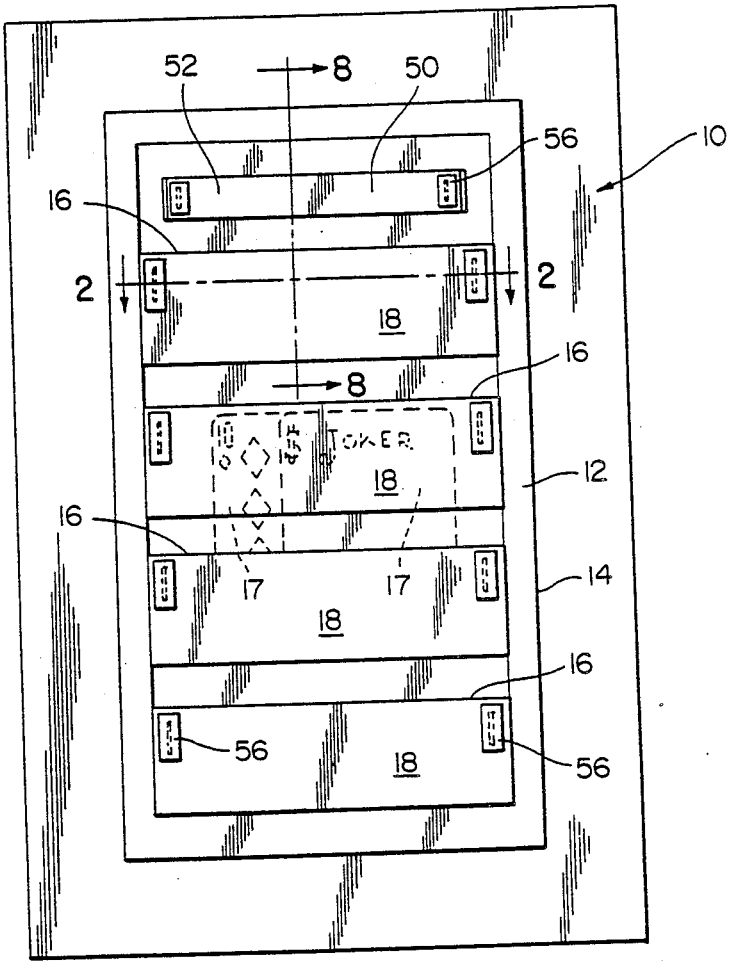
FIG. 1 is a top plan view of a panel constructed in accordance with the present invention and including card receiving pocket defining structure operatively associated therewith defining four card receiving pockets.
Figure 2:
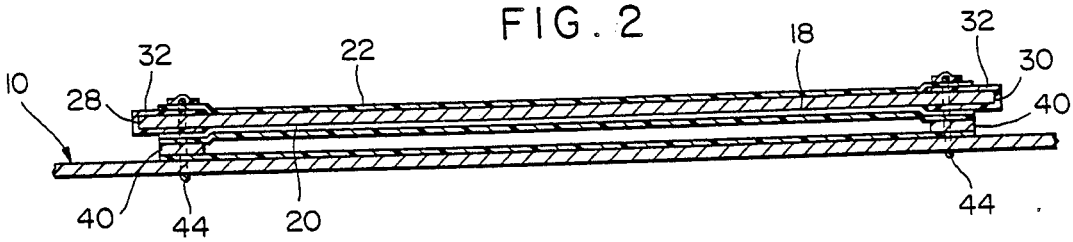
FIG. 2 is an enlarged fragmentary sectional view taken substantially upon the plane indicated by the section line 2—2 of FIG. 1.
Figure 3:
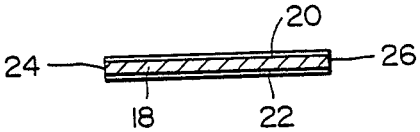
FIG. 3 is a transverse sectional view of a stiff strip member utilized in forming each pocket and with the end of the strip member (constructed of cardboard) covered by a flexible decorative strip.

Referring now more specifically to the drawings the numeral 10 generally designates a card game playing panel constructed in accordance with the present invention. The panel 10 comprises a generally rectangular panel which is approximately fourteen inches in length and nine inches in width, but which may be considerably larger or smaller, as desired. Further, the panel is constructed of multi-ply cardboard, but may be of any suitable material.

The panel 10 includes a first flexible decorative sheet 12 disposed over central area 14 of the panel 10. The sheet 12 is provided with an adhesive layer (not shown) on the side thereof opposing the panel 10 and adhered thereto. Although the sheet 12 includes marginal edges spaced inward of the corresponding marginal edges of the panel 10, the sheet 12 could fully cover the opposing side of the panel 10 and, in FIGS. 2–8 the sheet 12 is to be considered as a portion of the panel 10 and is not separately illustrated.

The panel 10 defines four card receiving pockets 16 which each may receive a single playing card 17 therein or a plurality of playing cards 17 therein.

Referring now more specifically to FIGS. 3–8, each pocket 16 is defined by an elongated, stiff strip member 18 including opposite longitudinal side faces 20 and 22, opposite longitudinal side edges 24 and 26 and opposite transverse end edges 28 and 30. The strip member 18 also may comprise a multi-ply cardboard member and the opposite ends thereof are covered by flexible strips 32 of decorative material (such as sheet plastic or vinyl, etc.) provided with an adhesive coating (not shown) on one side thereof by which the strips 32 are secured to the opposite ends of the strip member 18. The flexible strips 32 are lapped over the side faces 20 and 22 adjacent each end of the strip member 28 and also pass over the end edges 28 and 30.

Figure 4:
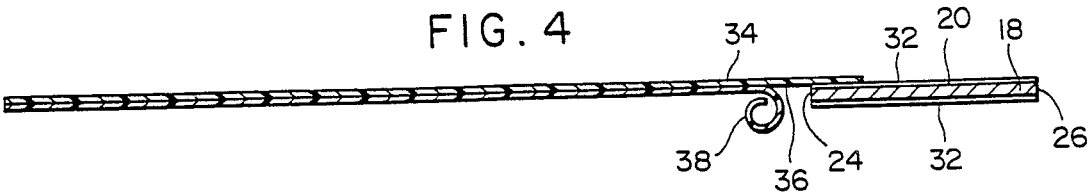
FIG. 4 is a transverse sectional view of one of the stiff strip members such as that illustrated in FIG. 3 and having one end edge of an elongated, flexible decorative sheet adhered thereto prior to wrapping of the strip member within the decorative sheet, one side of the decorative sheet having an adhesive coating thereon provided with a protective removable cover membrane.
Figure 5:
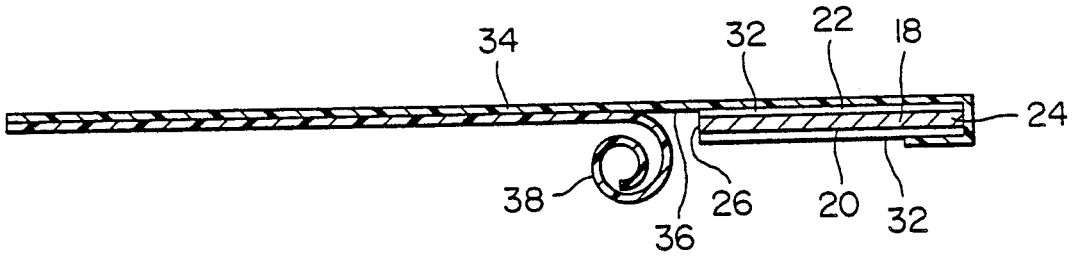
FIG. 5 is a sectional view similar to FIG. 4 but illustrating the stiff panel member in a further wrapped condition.

In order to form each pocket 16, one end portion of an elongated, flexible decorative sheet 34 having one adhesive coated face 36 with a release sheet 38 disposed thereover is applied and adhered to the side face 20 of the strip member 18 adjacent the longitudinal side edge 24 in the manner illustrated in FIG. 4. Then, the release sheet 38 is further stripped from the adhesive coated face 36 and the decorative sheet 34 passes over the longitudinal side edge 24 and also fully across the side face 22 of the strip member, the decorative sheet 34 also passing over the adjacent portions of the flexible strips 32, see FIG. 5. Thereafter, the release sheet 38 is further removed from the adhesive coated face 36 of the decorative strip 34 and passed over the longitudinal side edge 26 and thereafter fully across the side face 20 of the strip member 18, see FIG. 6.

Figure 6:
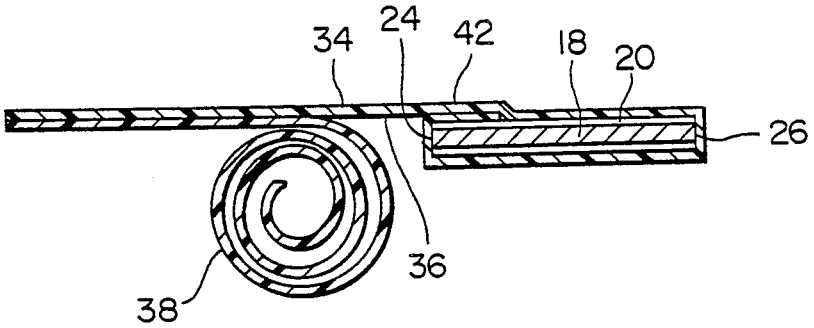
FIG. 6 is a sectional view similar to FIG. 5 but illustrating the stiff strip member in a fully wrapped condition.
Figure 7:
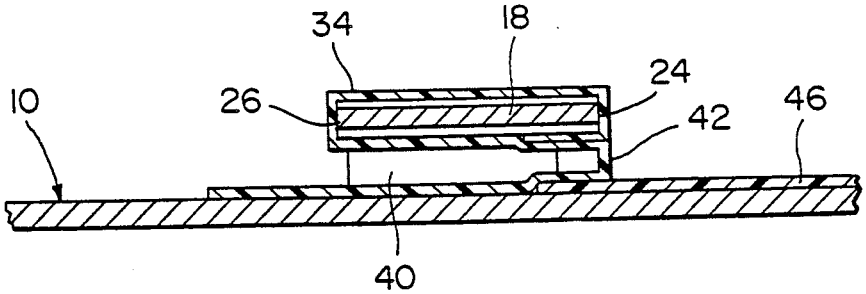
FIG. 7 is a sectional view of the stiff strip member of FIG. 6 as adhered to a designated area of a support panel therefore and with the wrapped stiff member flipped back over a spacing strip.

Thereafter, the entire assemblage of FIG. 6 is positioned relative to the panel 10, the release sheet 38 is fully removed and the other end portion of the sheet 34 is adhered to the panel 10 in the manner illustrated in FIG. 7 after which a pair of narrow cardboard strips 40 are disposed over longitudinal opposite side edges of that portion of the decorative sheet 34 closely adjacent a transverse fold zone 42 of the decorative sheet 34 disposed between the opposite end portions thereof. Thereafter, the strip member 18 is flipped or folded over the narrow strips 40 in the manner illustrated in FIG. 7. The narrow strips 40 are somewhat shorter than the transverse width of the strip member 18 and space the opposite ends of the strip member 18 from the panel 10. Thereafter, suitable means 44 in the form of a staple may be used to secure each end of the strip member 18 and the corresponding narrow strip 40 to the panel 10.

Figure 8:
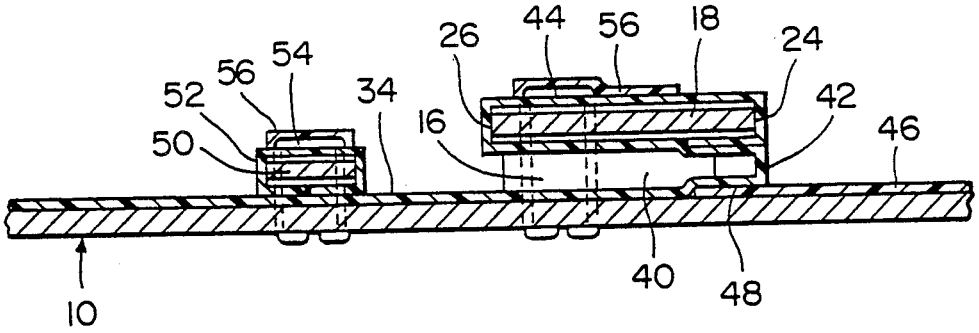
FIG. 8 is an enlarged fragmentary vertical sectional view taken substantially upon the plane indicated by the section line 8—8 of FIG. 1.

As may be seen in FIG. 8, the pocket 16 defined by each strip member 18, the corresponding narrow strips 40, the panel 10 and the decorative sheet 42 is open along the side edge 26 of the strip member 18, closed along the side edge 24 of the strip member 18 by the transverse fold zone 42 of the decorative sheet 34 and closed at its opposite ends by the narrow strips 40, the decorative sheet 34 having been applied to the panel 10 in overlapped engagement with a previously applied decorative sheet 46 as at 48. Thus, the strip member 18 forms a spacer outwardly of the previously applied pocket 16 (not shown) defined by an associated previously applied strip member (not shown) to the right of the strip member 18 illustrated FIG. 8. Also, upon the assumption that the pocket 16 is the left most pocket to be defined on the panel member 10 in FIG. 8, a narrow strip 50 wrapped in a decorative sheet 52 is secured to the panel 10 a spaced distance outward of the open side of the pocket 16 through the utilization of suitable fastening means such as a staple 54 to define a spacer for use in conjunction with the pocket 16 illustrated in FIG. 8. The exposed upper ends of the staples 44 and 54 may be covered by narrow strips 56 of an adhesive decorative sheet.

It is to be noted that means other than the staples 44 and 54 may be used in securing the strip members 18 and the strip 50 to the panel 10. Also, the decorative sheets 34 and 46 not only serve to provide a decorative covering for the corresponding strip members, but they also serve as the means for closing the longitudinal edges of the pockets 16 adjacent the side edges 24 of the strip members 18.

With attention now invited more specifically to FIG. 1, it may be seen that approximately one-half the length of the playing cards 18 are received within the associated pocket and that the exposed ends of the playing cards 17 pass over the strip member 18 disposed outwardly of the open side of the pocket in which the cards 17 are received. Thus, it may be seen that the playing cards 17 will be longitudinally bowed in order that the free ends thereof may pass over the associated spacer. Furthermore, it is to be understood that the vertical thicknesses of the various components illustrated in FIG. 8 are exaggerated for clarity purposes and that, because the transverse fold zone 42 is of considerably less height than illustrated in FIG. 8, even a single playing card 18 may have one end thereof tightly frictionally retained within the associated pocket 16. Thus, even if the panel 10 is upset by wind, all playing cards 18 disposed in pockets 16 will be frictionally retained therein.

The strip members 18 are relatively stiff, as are the narrow strips 40 and the strip 50 and panel 10. However, these components may be constructed of multi-ply cardboard and, thus, in order to construct the overall panel 10 as shown in FIG. 1, only a single panel, the equivalent of four strip members 18 and the six narrow strips 16 in addition to the adhesive faced decorative sheets are required in addition to the staples 44 and 54, or other suitable securing means are required to enable, the panel 10 to be manufactured with great ease and at a very low cost.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A card pocket equipped card game playing panel, said panel comprising a stiff panel defining at least one predetermined area thereof for supporting cards on said panel, an elongated, flat, stiff strip member including opposite longitudinal side faces, opposite longitudinal side edges and opposite transverse end edges, an elongated flexible decorative sheet of a width extending between side edges of said sheet at least substantially equal to the length of said strip member, one end portion of said sheet being anchored to and extending lengthwise along a first side face of said strip member and with said sheet lengthwise encircled transversely about said strip member first over one of said side edges, thereafter across said second side face, thereafter over the other of said side edges and then over said first side face with the other end portion of said sheet extending appreciably outwardly of said wrapped one side edge, the side of at least said other end portion of said sheet corresponding to the side of said sheet opposing said strip member being placed upon said area and adhered thereto, the side edges of said other end portion of said sheet adhered to said area having narrow, elongated strips disposed thereover and extending lengthwise therealong with said narrow strips spaced from said one side edge and the terminal end of said other end portion of said sheet, said wrapped strip member being folded, using said other end portion of said sheet adjacent said one side edge as a hinge, back over said narrow strips, said folded wrapped strip member and narrow strips being anchored to said narrow strips and said other end portion of said sheet, respectively, and a second elongated strip member overlying, secured to and extending transversely across said other end portion of said sheet and generally paralleling and laterally spaced outward from said other side edge of the first mentioned strip member.

2. The panel of claim 1 wherein said second elongated strip member comprises a wrapped strip member corresponding to said first mentioned strip member wrapped by a second flexible decorative sheet corresponding to the first mentioned decorative sheet and with the end portion of said second flexible decorative sheet corresponding to said other end portion of the first mentioned flexible decorative sheet adhered to said panel and overlapped engaged with the terminal end of said other end portion of the first mentioned decorative sheet.

3. The panel of claim 1 wherein at least substantially the entire side of said flexible decorative sheet opposing the first mentioned strip member is adhered to the latter and to said area of said panel.

4. The panel of claim 1 wherein said narrow strips and the ends of said strip member are secured to said panel and narrow strips, respectively, by fasteners secured through the last mentioned ends, said narrow strips and said panel.

5. The panel of claim 1 wherein said fasteners comprise staples.

6. A card pocket equipped card game playing panel, said panel comprising a stiff panel defining at least one predetermined area thereof for supporting cards on said panel, an elongated flexible sheet having opposite end portions and opposite longitudinal side edges, one end portion of said sheet being secured to said panel, a pair of flat, narrow, elongated and laterally spaced parallel spacing strips disposed over, extending along and anchored relative to the side edges of said one end portion, an elongated, flat, stiff strip member having opposite longitudinal margins, said other end portion of said flexible sheet being wrapped at least partially about and secured to said strip member, said strip member extending lengthwise between and having its opposite ends disposed over and secured to said strips with said strip member, panel, strips and flexible sheet defining a card receiving pocket therebetween opening outwardly along said panel at one longitudinal margin of said strip member between one pair of corresponding ends of said strips and closed along the other longitudinal margin of said strip member and the other pair of corresponding ends of said spacing strip by a narrow transverse folded zone of said flexible sheet disposed between said opposite end portions of said flexible sheet.

7. The panel of claim 6 wherein one side, only, of said flexible sheet includes an adhesive coating and said one side of said one and other opposite end portions of said flexible sheet are adhesively secured to said panel and strip member, respectively.

8. The panel of claim 6 including fastening means secured through said opposite ends of said strip member, said strips and said panel.

9. The panel of claim 8 wherein one side, only, of said flexible sheet includes an adhesive coating and said one side of said one and other opposite end portions of said flexible sheet are adhesively secured to said panel and strip member, respectively.

10. The panel of claim 7 wherein said fasteners comprise staples.

11. The panel of claim 6 including a second elongated strip member secured over said panel, generally paralleling and closely spaced from said one longitudinal margin of the first mentioned strip member.

12. The panel of claim 11 wherein the thickness of said second elongated strip member, measured in a direction perpendicular to said panel, is generally equal to the width of said pocket measured in said direction.

13. The panel of claim 12 wherein one side, only, of said flexible sheet includes an adhesive coating and said one side of said one and other opposite end portions of said flexible sheet are adhesively secured to said panel and strip member, respectively.

14. The panel of claim 13 including fastening means secured through said opposite ends of said strip member, said strips and said panel.

15. The panel of claim 14 wherein said fasteners comprise staples.

* * * * *